US007179978B2

(12) United States Patent
Takegawa

(10) Patent No.: US 7,179,978 B2
(45) Date of Patent: Feb. 20, 2007

(54) FOOT ACTIVATED PEDAL SYSTEM FOR PERCUSSION INSTRUMENT

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 10/928,268

(22) Filed: Aug. 30, 2004

(65) Prior Publication Data

US 2005/0223876 A1 Oct. 13, 2005

Related U.S. Application Data

(60) Provisional application No. 60/561,522, filed on Apr. 13, 2004.

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS 5,431,081 A 7/1995 Lombardi et al.
5,565,638 A 10/1996 Liao
6,100,460 A * 8/2000 Hoshino ..... 84/422.1

* cited by examiner

*Primary Examiner*—Kimberly Lockett
(74) *Attorney, Agent, or Firm*—Berenato, White & Stavish

(57) ABSTRACT

The pedal hinge system comprises a hinge interconnecting a footboard and a heel plate, wherein the hinge includes a pair of threaded pins that are each successively fitted into two bearing sleeves with a set screw securely locking each threaded pin in place. The inner bearing sleeve fits into the heel plate to lock the hinge assembly together while the outer bearing sleeve fits into hinge ears of the footboard to insure smoother action and less unwanted play.

12 Claims, 5 Drawing Sheets

FOOT ACTIVATED PEDAL SYSTEM FOR PERCUSSION INSTRUMENT

CROSS-REFERENCE TO RELATED APPLICATION

This application claims the benefit under 35 U.S.C. 119(e) of U.S. Provisional Application No. 60/561,522 filed Apr. 13, 2004 by Akito TAKEGAWA.

BACKGROUND OF THE INVENTION

1. Field of the Invention

The present invention relates generally to foot activated musical percussion devices and more particularly to foot pedals used in conjunction with musical instruments, which translates foot motion into rotary or translational motion.

2. Description of Related Art

Foot activated pedal systems are typically used for drums, hi-hat and other percussion instruments. As shown in FIG. 1, the foot-activated pedal system typically includes a base 1, a heel plate 2, and a foot board 3.

Standard foot activated musical drum pedal devices are known in the prior art to include generally a base, a heel plate, a footboard and, mallet head mechanically linked together to translate foot motion into a drum beating activity. These devices are generally used in conjunction with a large musical bass drum. The pedal device generally is fixed to a bottom portion of the bass drum rim. The musician generally sits back and above the pedal device. The device is activated by the musician depressing the foot pedal which causes the mallet head to impact a surface of the bass drum.

Standard foot-activated "hi-hat" devices are known in the prior art to include generally a base, a heel plate, and a footboard mechanically linked to a vertical shaft through which a rod is coaxially mounted. See FIG. 1. A cymbal is mounted on both the rod and shaft in opposed relationship and a spring is attached to the rod to urge it upwardly, when the pedal is not being depressed, to keep the cymbals spaced apart. Downward movement of the pedal brings the cymbals together in percussive engagement and upward movement of the pedal under the spring force returns the cymbals to disengaged position. Thus, in prior "hi-hats", one cycle of the pedal movement produces one beat.

Stability and feel are critical to effective operation of the foot activated pedals associated with percussion instruments. Drummers prefer a smooth stroke and consistent feel when using these pedal assemblies. One drawback in the prior art devices is the hinge assembly where the pivoting footboard is hingedly fixed to the heel plate.

FIGS. 2 and 3 illustrate two prior art hinge assemblies. The conventional pedal hinge of FIG. 2 comprises a single press-fit pin 10 which mates with a pair of nylon sleeves 11. The conventional pedal hinge system of FIG. 3 comprises a pair of threaded pins 10' and a corresponding pair of nylon sleeves 11'. However, the hinge assembly for these designs often broke due to the vibration and rapid movement associated with these pedal assemblies.

The need therefore exist for a durable and effective foot activated pedal assembly with an improved hinge.

SUMMARY OF THE INVENTION

The present invention provides an improved foot activated musical drum impacting device by providing a durable and effective hinge assembly between the hinged pedal and the foot plate.

The pedal hinge system comprises a hinge interconnecting a footboard and a heel plate, wherein the hinge includes a pair of threaded pins that are each successively fitted into two bearing sleeves with a set screw securely locking each threaded pin in place. The inner bearing sleeve fits into the heel plate to lock the hinge assembly together while the outer bearing sleeve fits into hinge ears of the footboard to insure smoother action and less unwanted play.

These and other objects of the present invention will become apparent from the following specification and are accomplished by means hereafter described and claimed, the invention being measured by the appended claims and not by the details of the specification.

DETAILED DESCRIPTION OF PREFERRED EMBODIMENT

Figure 1:
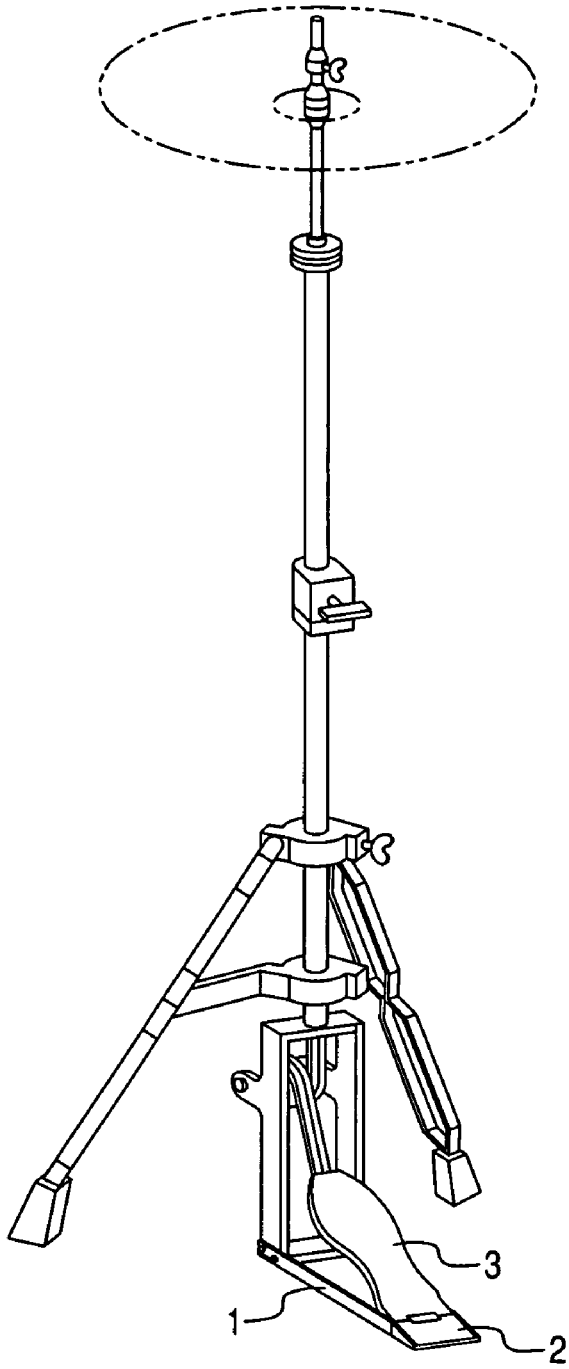
Fig. 1 Prior Art
FIG. 1 illustrates a general form and layout of a percussion pedal assembly with a heel plate and footboard associated with a hi-hat system.
Figure 2:
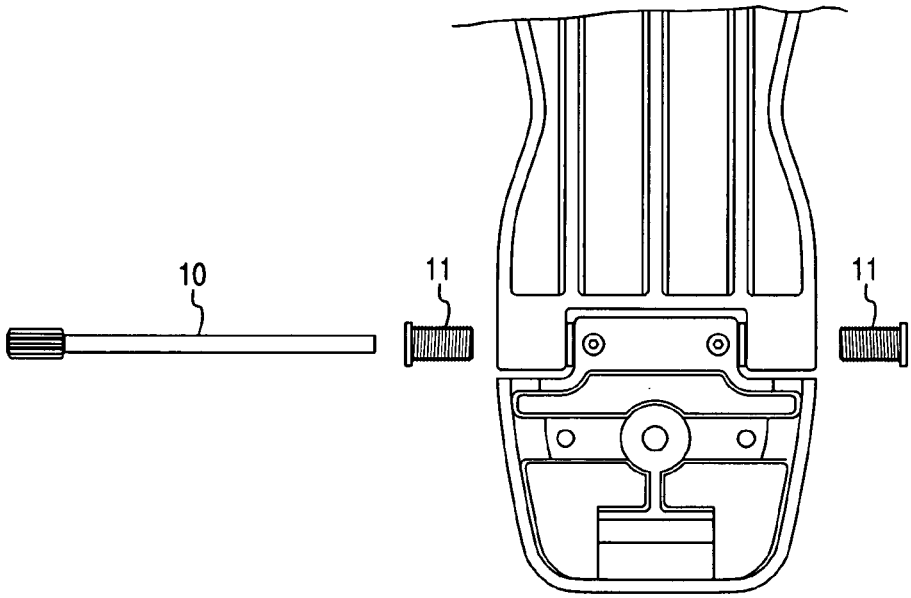
Fig. 2 Prior Art
FIG. 2 is a conventional pedal hinge system comprising a single press-fit pin and a pair of nylon sleeves.
Figure 3:
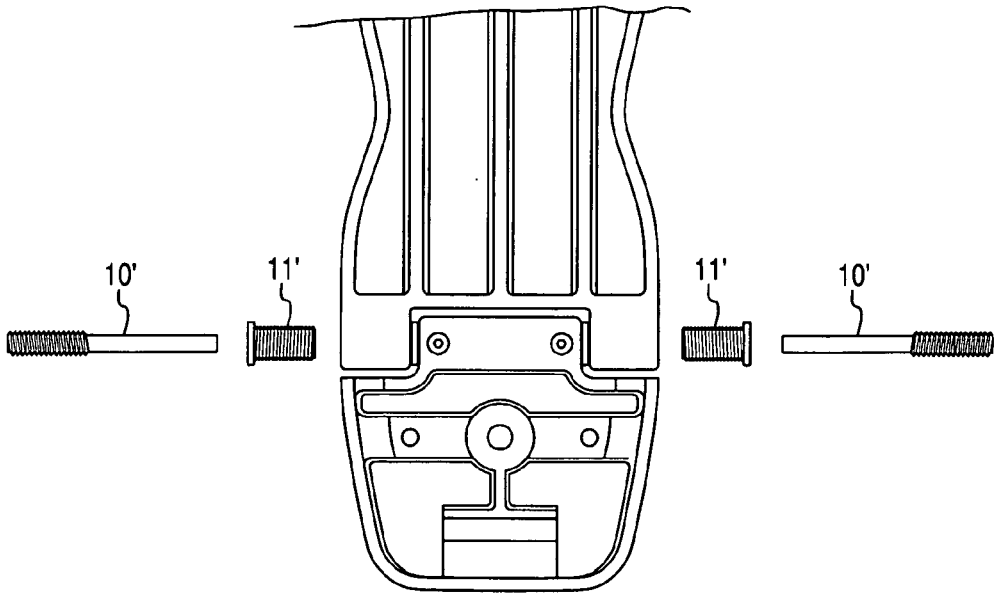
Fig. 3 Prior Art
FIG. 3 is a conventional pedal hinge system comprising a pair of threaded pins and a corresponding pair of nylon sleeves.
Figure 4:
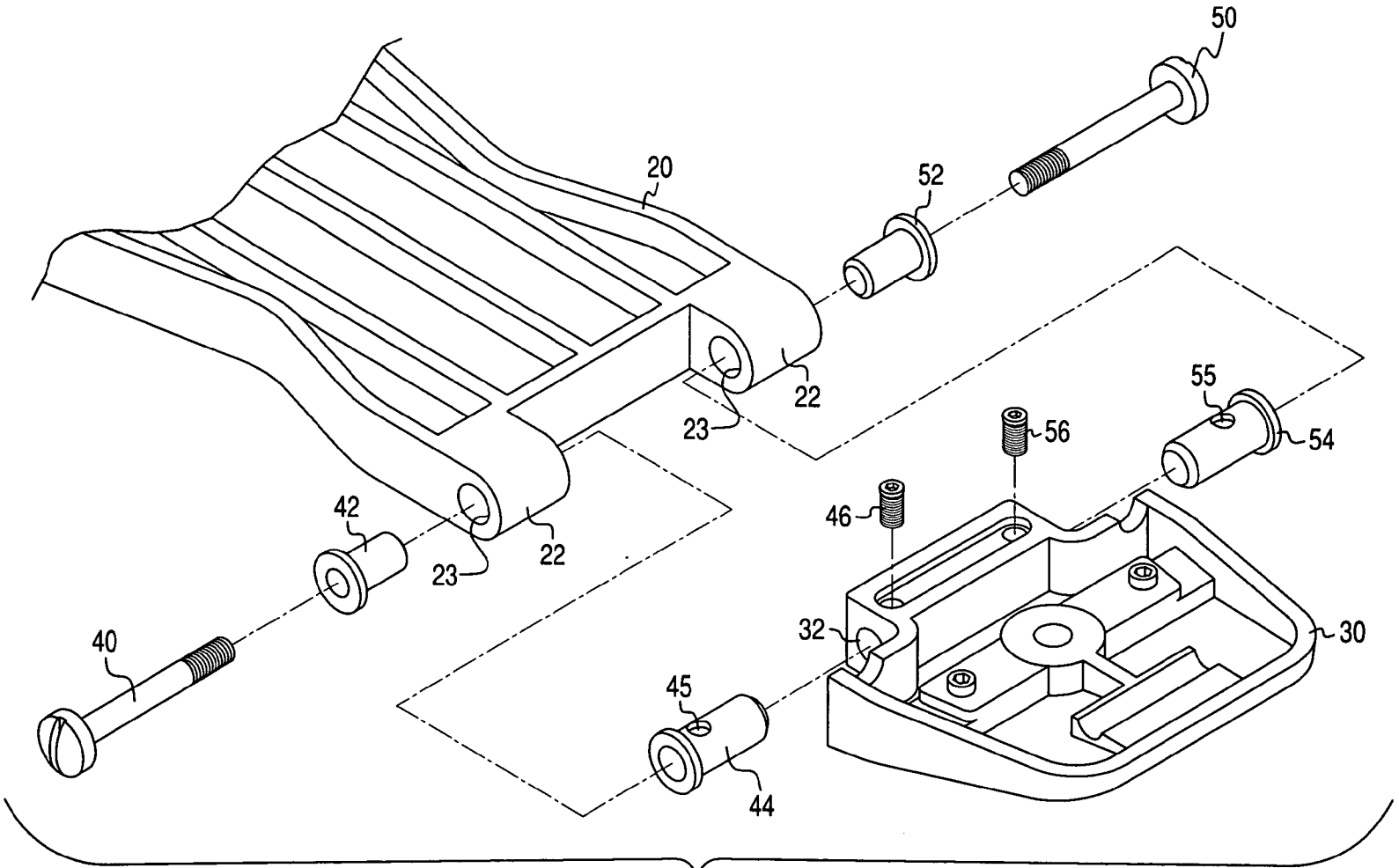
FIG. 4 is an exploded view of the pedal hinge system according to this invention.
Figure 5:
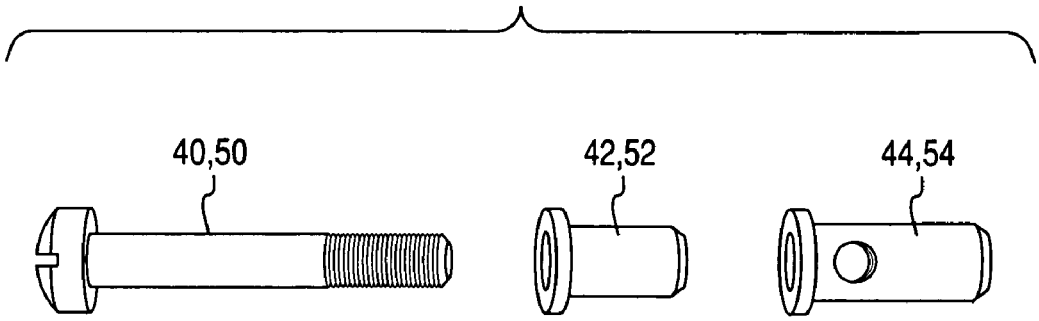
FIG. 5 is an enlarged view of the pin and nylon sleeves shown in FIG. 4.
Figure 8:
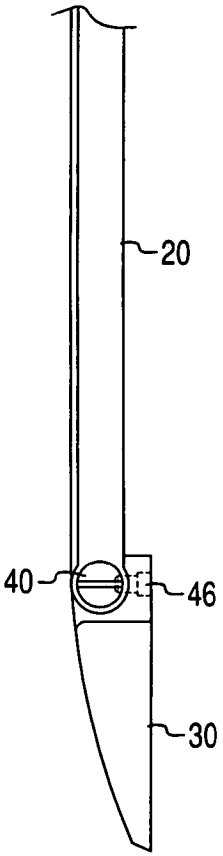
FIG. 8 is a side view of the pedal hinge assembly according to this invention.

Referring to FIG. 4, a footboard 20 is hinged to a heel plate 30 through a hinge assembly. The hinge assembly comprises threaded screws 40, 50; outer bearing sleeves 42, 52; inner bearing sleeves 44, 54; and set screws 46, 56 that hold the threaded screws 40, 50 in place. As shown in FIG. 4, the inner bearing sleeves 44, 54 are received in bearing apertures 32 formed in the heel plate 30 and the outer bearing sleeves 42, 52 are received in footboard apertures 23 formed in hinge ears 22 of the footboard 20.

The threaded screws 40, 50 pass through each respective inner and outer bearing sleeve 42, 44, 52, 54. The threaded screws 40, 50 are threaded into threaded bores formed in the heel plate 30. Set screws 46, 56 are threaded into the heel plate 30 in such location to frictionally lock the inner bearing sleeves 44, 54 and threaded screws 40, 50 in place.

The bearing sleeves are preferably formed of nylon or other suitable material that provides a smooth frictional rotation between the heel plate 30 and footboard 20.

Figure 7:
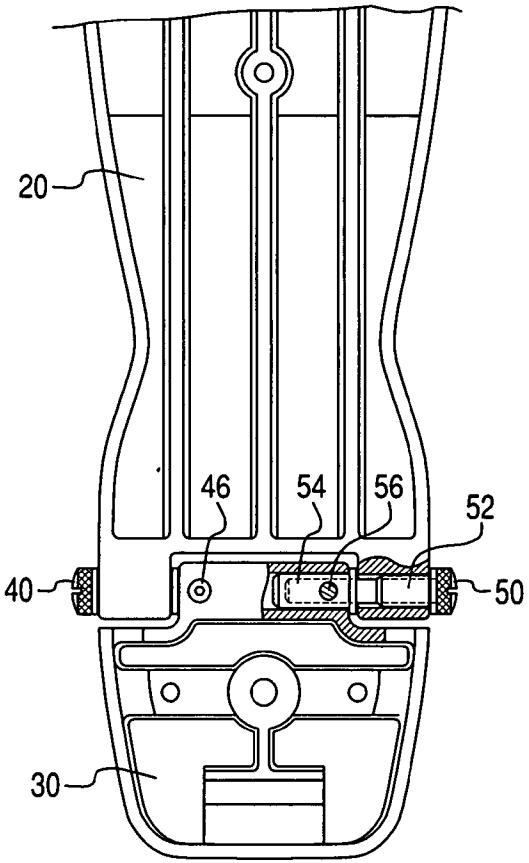
FIG. 7 is a bottom view of the pedal hinge assembly including the set screws of this invention in the assembled state.
Figure 6:
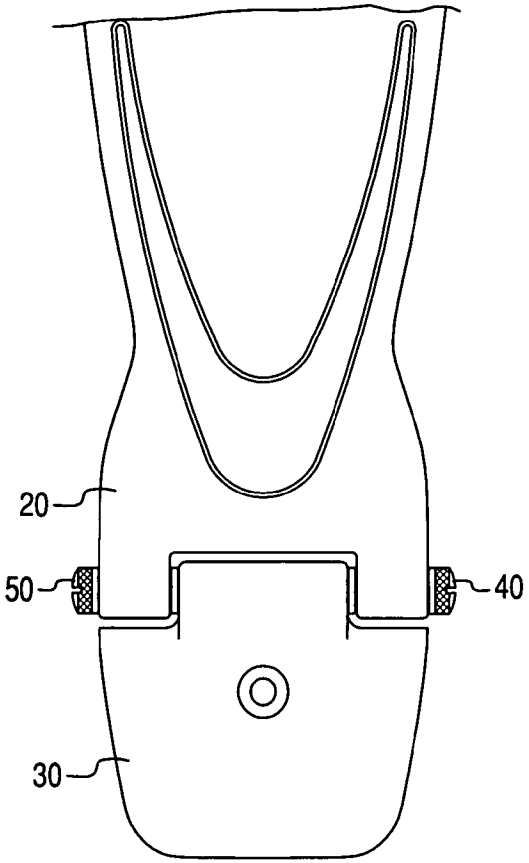
FIG. 6 is a top view of a pedal hinge assembly according to this invention in the assembled state.

The inner bearing sleeves 44, 54 are preferably formed with a lateral aperture 45, 55 to receive the leading end of the set screws 46, 56; whereby, the set screws 46, 56 may frictional engage the threaded screws 40, 50. Additionally, an enlarged head portion of the inner bearing sleeves 44, 54 provides a controlled lateral separation between the heel plate 30 and the hinge ears 22 of the footboard 20 as shown in FIGS. 6 and 7.

While the forgoing invention has been shown and described with reference to a preferred embodiment, it will be understood by those of skill in the art that various changes in form and detail may be made therein without departing from the spirit and scope of the present invention.

The invention claimed is:

1. A hinge assembly for a foot assembly comprising:

a heel plate including a hinge portion with at least one heel plate aperture;

a footboard including a footboard hinge end with at least one footboard aperture;

at least one outer bearing sleeve disposed in said footboard aperture;

at least one inner bearing sleeve disposed in said heel plate aperture; and at least one hinge pin passing through said inner and outer bearing sleeves to pivotally couple said footboard to said heel plate;

a set screw frictionally engaging said hinge pin to lock said pin with respect to the said heel plate, wherein said inner bearing sleeve includes a lateral aperture through which said set screw passes.

2. The hinge assembly according to claim 1, wherein said at least one hinge pin comprises first and second hinge pins, wherein said first hinge pin passes through a first outer bearing sleeve and a first inner bearing sleeve and a second inner bearing sleeve.

3. The hinge assembly according to claim 2, further comprising first and second set screws frictionally engaging said first and second hinge pins to lock said first and second hinge pins with respect to said heel plate.

4. The hinge assembly according to claim 1, wherein said at least one inner bearing sleeve comprises enlarged head portions interposed between said heel plate and said footboard to maintain a spacing therebetween.

5. The hinge assembly according to claim 1, whereinsaid inner and outer bearing sleeves are nylon bearing sleeves.

6. The hinge assembly according to claim 1, wherein said at least one hinge pin is a threaded member that threadingly engages said heel plate.

7. A hinge assembly for a foot pedal assembly comprising:

a heel plate including a hinge portion with at least one heel plate aperture;

a footboard including a footboard hinge end with at least one footboard aperture;

first and second outer bearing sleeves disposed in said footboard aperture;

first and second inner bearing sleeves disposed in said heel plate aperture; and first and second hinge pins passing through said inner and outer bearing sleeves to pivotally couple said footboard to said heel plate;

said first hinge pin passing through said first outer bearing sleeve and said first inner bearing sleeve, and said second hinge pin passes through said second outer bearing sleeve and said second inner bearing sleeve.

8. The hinge assembly according to claim 7, further comprising first and second set screws frictionally engaging said first and second hinge pins to lock said first and second hinge pins with respect to said heel plate.

9. The hinge assembly according to claim 8, wherein each of said first and second inner bearing sleeves includes a lateral aperture through which one of said first and second set screw passes.

10. A hinge assembly for a foot pedal assembly comprising:

a heel plate including a hinge portion with at least one heel plate aperture;

a footboard including a footboard hinge end with at least one footboard aperture;

at least one outer bearing sleeve disposed in said footboard aperture;

at least one inner bearing sleeve disposed in said heel plate aperture; and at least one hinge pin passing through said inner and outer bearing sleeves to pivotally couple said footboard to said heel plate;

said at least one hinge pin being a threaded member threadingly engaging said heel plate wherein said at least one inner bearing sleeve comprises enlarged head portions interposed between said heel plate and said footboard to maintain a spacing therebetween.

11. The hinge assembly according to claim 10, further comprising a set screw frictionally engaging said hinge pin to lock said hinge pin with respect to the said heel plate.

12. The hinge assembly according to claim 10, wherein said inner bearing sleeve includes a lateral aperture through which said set screw passes.

* * * * *